United States Patent [19]

Mooney

[11] 4,280,209

[45] Jul. 21, 1981

[54] ELECTRONIC ALARM CLOCK

[75] Inventor: Jac A. Mooney, Great Neck, N.Y.

[73] Assignee: Bradley Time Division, Elgin National, New York, N.Y.

[21] Appl. No.: 913,384

[22] Filed: Jun. 7, 1978

[51] Int. Cl.[3] ..... G04B 25/00; G04B 19/00; G04C 19/00

[52] U.S. Cl. ..... 368/71; 368/73; 368/76; 368/82; 368/251

[58] Field of Search ..... 58/50 R, 57.5, 21.11, 58/21.12, 24 R, 24 A, 35 R, 38 R, 153, 21.1, 19 R, 16 R, 16 D; 368/71–73, 76, 82, 251

[56] References Cited

U.S. PATENT DOCUMENTS

| | | | |
|---|---|---|---|
| 3,931,703 | 1/1976 | Scherrer | 58/23 R |
| 3,945,191 | 3/1976 | van Berkum | 58/50 R |
| 4,045,951 | 9/1977 | Tanaka | 58/50 R |
| 4,104,865 | 8/1978 | Sasaki | 58/57.5 |

*Primary Examiner*—Vit W. Miska

*Attorney, Agent, or Firm*—Michael Ebert

[57] ABSTRACT

An electronic timepiece having an analog time display and a digital alarm setting system for actuating an alarm at a preset time. The timepiece includes a high-frequency time base whose output is applied to a frequency converter yielding low frequency timing pulses, these being applied to a motor for driving the hour and minute hands through a gear train. The alarm setting system includes an electro-optical digital display whose electronic actuator responds to the same timing pulses to provide a digital display concurrent with the analog display, and a microprocessor associated with a data memory adapted to store the digital value of any selected time setting. The microprocessor compares the existing time expressed as digital data with the stored digital value to produce a representative output signal when the existing value is coincident with the stored value. The output signal acts to trigger an alarm generator to produce an alarm for a predetermined period.

7 Claims, 4 Drawing Figures

ELECTRONIC ALARM CLOCK

BACKGROUND OF THE INVENTION

This invention relates generally to electronic timepieces having an analog display adapted to produce audible signals at preset times, and more particularly to a timepiece including time and calendar computers and a digital display setting system provided with a microprocessor for selectively producing alarm signals, hourly chimes or musical time signatures as well as special birthday or holiday greetings.

In the traditional mechanical clock, the hour and minute hands which turn about the clock face are operated through a gear train driven by a spring motor. When the wind-up clock is of the alarm type, an additional hand is provided that is manually-adjustable to a desired alarm setting, so that when the hour and minute hands reach this setting, an audible alarm is actuated.

Because of inherent mechanical limitations, the setting mechanism of a conventional alarm clock operates inexactly, so that even though the alarm setting hand is positioned, say, at 8:30, the alarm will not be triggered at precisely 8:30 but a few minutes before or after this setting. And because it operates on a scale of 12, a mechanical alarm clock is unable to distinguish between AM and PM, so that if the alarm hand is set at 8:30 and one wishes to be awakened at 8:30 AM, one must be sure to pull out the alarm-enabling button after 8:30 PM to avoid having the alarm go off at this time rather than 8:30 AM.

In recent years, solid state timepieces have been developed which have no moving parts and are capable of displaying in digital terms not only the time but also the date (day and month). One such electronic timepiece is disclosed in U.S. Pat. No. 3,839,856 (1975) to Dargent, whose entire disclosure is incorporated herein by reference.

In an electronic timepiece disclosed in this patent, a high-frequency crystal-controlled oscillator functioning as a time base is coupled through a frequency divider and a display actuator to an electro-optical digital display formed by light emitting diodes (LED). Through the use of large-scale integrated circuit (LSI) techniques, all of the electronic components of the timepiece are fabricated on one or more small silicon chips. Setting is accomplished by actuating either an hour-set or minute-set switch.

In addition to the basic LSI time computer, the Dargent timepiece includes a separate LSI calendar circuit which automatically counts to 30 or 31 days according to the month of the year, except for February when it automatically counts to 29. The calendar circuit makes it possible to display the day and month digitally (say, 2:12 for the 2nd of December).

While a crystal-controlled electronic digital timepiece is far more accurate than a conventional mechanical timepiece, its digital display, whether in LED or liquid crystal (LCD) form, is not as readable as the conventional analog display. Readability, in the sense this term is used in human factors engineering, is unrelated to accuracy. Hence a digital display may be more accurate than an analog display, yet less readable.

The reason for this is that when the hands of a clock indicate, say, six minutes to twelve, what the observer primarily sees is the sector defined by the hour and minute hands. From the size of this sector and its angular orientation and without regard to the dial numbers underlying the hands, the observer perceives that the time is shortly before noon or midnight, for at 12 the hands overlap to extinguish the sector. The equivalent digital display is 11:54, but the significance of this number in terms of how close this time is to noon or midnight requires an intellectual exercise on the part of the observer which is more difficult to carry out than analog perception.

To give a simple example of this distinction: If in order to describe the size of a cat, you hold your hands apart by a distance analogous to the cat size, this give the observer an immediate impression of the physical dimension. If, however, you tell the observer that the cat is 13.55 inches long, though this is more exact, it is more difficult to conceive in actual physical terms.

While a person must be trained or conditioned to tell time in analog terms and the meaning of time expressed in digits is more readily acquired, the fact remains that once one learns to read timekeeping hands, it affords more useful intelligence; for an analog reading not only gives the existing time but also indicates where that time stands with respect to four angular reference or compass points (12, 3, 6 and 9). It is for this reason that aircraft pilots often describe the incoming direction of a plane in terms of analog time—and will say, for instance, that a plane is approaching at 2 o'clock.

Moreover, an analog display, because it it seen in the form of the relatively large sector defined by hands, can be read at a greater distance than a digital display. One can read an analog dial display even though the distance from the display and the lighting conditions are such that the dial numbers cannot be deciphered, whereas one must be close enough to a digital display to be able to discern the numbers.

Hence while modern solid state timepieces in many respects represent a major advance over spring-operated mechanisms having a moving hand display, because of the advantages of an analog display in terms of human factors engineering, many electronic watches and clocks now on the market include a gear train for turning conventional watch hands, the train being driven by a stepping motor actuated by low-frequency timing pulses derived from the time computer included in the timepiece.

SUMMARY OF INVENTION

In view of the foregoing, the main object of this invention is to provide an electronic alarm clock having an analog display operated by timing pulses derived from an electronic time computer and a digital alarm setting system actuated by the same pulses for setting the alarm.

A significant advantage of an electronic alarm clock in accordance with the invention is that the existing time is indicated in a highly readable analog form, whereas the alarm setting, which is expressed in digital terms, acts to trigger off the alarm at the precise instant of the setting.

Also an object of the invention is to provide an electronic alarm clock of the above type in which the analog display is on a scale of 12, whereas the digital setting system operates on a scale of 24, whereby the alarm goes off at a preset time which lies within either the AM or PM period.

Yet another object of this invention is to provide an electronic clock which is adapted to electrically generate synthetic sound chimes or musical time signatures, every hour on the hour, and to produce at pre-selected calendar dates—birthday, anniversary or special holiday songs.

Briefly stated, an electronic timepiece in accordance with the invention comprises a high-frequency time base whose output is applied to a frequency converter yielding low frequency timing pulses which are applied to a motor for driving the analog display hands of the timepiece through a gear train.

The timing pulses are also applied to the electronic display actuator of an electro-optical LED or LCD display setting system which provides a digital display in a 24-hour range concurrent with the analog display. The setting system includes a microprocessor provided with a data memory adapted to store in digital terms any selected alarm time setting. The microprocessor compares this setting with existing time expressed digitally and produces a representative output signal when the existing time is coincident with the setting. The output signal acts to trigger an alarm generator to produce an alarm for a predetermined period.

Also associated with the microprocessor is a sound memory in which there is stored chimes and musical time signatures in digital synthetic sound form. Stored in the data memory in digital terms are the hours 01 to 24 of a day, the microprocessor comparing the existing time expressed digitally with the stored hours to produce a representative output signal when the existing time is coincident with each of these stored hours. The microprocessor then extracts a digitized synthetic chime or musical time signature from the sound memory that is appropriate to the stored hour and applies the digitized synthetic signal to a digital-to-analog converter whose output is fed to a sound reproducer.

To provide birthday, holiday or other special day greetings, such greetings, which may be in the form of songs appropriate to the days, are stored in digitized synthetic sound form in the sound memory. A calendar circuit responsive to the timing pulses, acting to count the days of each month of the year, is associated with the digital display whereby the digital setting system is settable to the special dates, the selected dates being stored in the data memory. The microprocessor compares the dates stored in the data memory with the existing date obtained from the calendar circuit, such that when coincidence occurs, the appropriate special day greeting is extracted from the sound memory and the resultant digitized synthetic signal is fed through the digital-to-analog converter to the reproducer.

OUTLINE OF DRAWINGS

For a better understanding of the invention as well as other objects and further features thereof, reference is made to the following detailed description to be read in conjunction with the accompanying drawings, wherein.

DESCRIPTION OF INVENTION

First Embodiment

Figure 1:
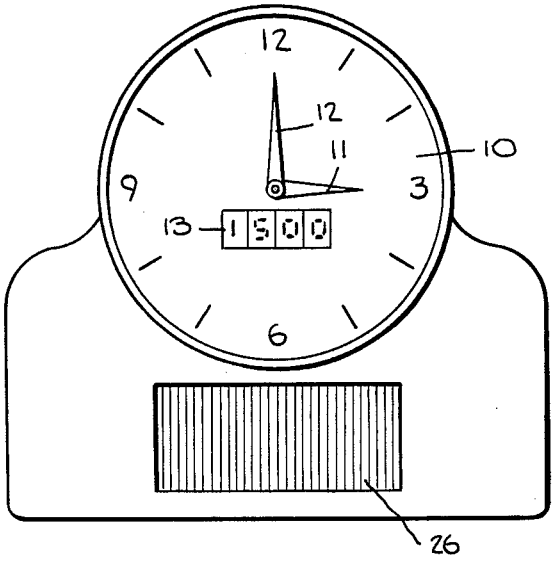
FIG. 1 illustrates the face of an electronic alarm timepiece in accordance with the invention.

Referring now to the drawing and more particularly to FIG. 1, there is shown an electronic alarm clock in accordance with the invention, the clock including a 12-hour dial 10 over which there is a rotating hour hand 11 and minute hand 12 providing a conventional analog time display.

Disposed below the central arbor on which the hands are supported is a digital electro-optic display 13 having four stations in order to provide time indications in hours and minutes. The arrangement is such that the digital and analog displays operate concurrently so that when the hands indicate 3:00, then if the time lies in the PM period, the digital display will indicate 1500 hours, for this display is of the 24-hour type. And since both displays are actuated by a common source of timing pulses, once the analog and digital displays are initially set to read the same time, they always remain in synchronism with each other.

Figure 2:
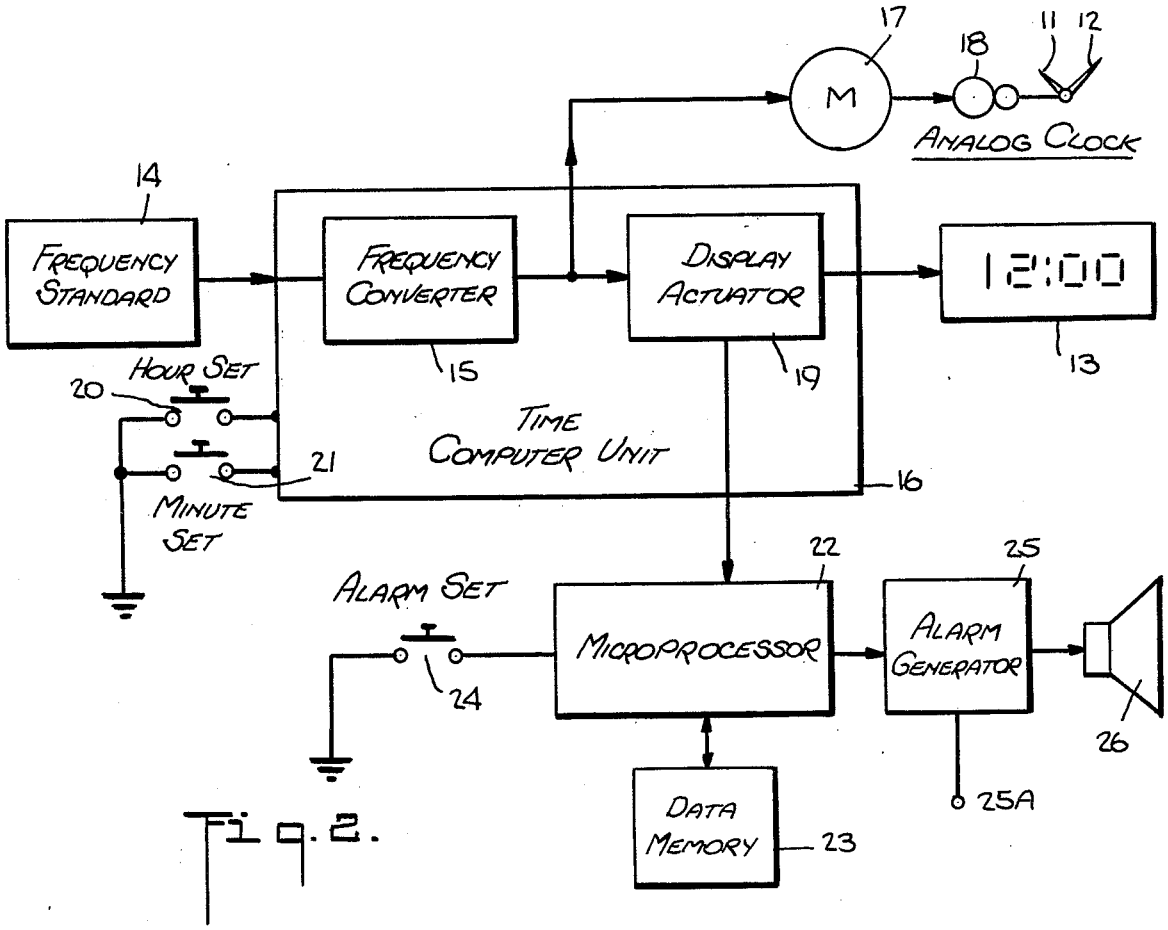
FIG. 2 is a block diagram of the circuit of the electronic timepiece.

Referring now to FIG. 2 which shows in simplified form the electronic arrangement for maintaining synchronous analog and digital displays, the time base or frequency standard of the clock is preferably constituted by a crystal-controlled oscillator 14 producing, say, a frequency of 32,768 Hz. The relatively high frequency output of oscillator 14 is supplied to the frequency-converter 15 of a time computer unit 16 of the type disclosed in the Dargent patent. The converter is in the form of a multi-stage binary frequency divider which divides down the frequency from the oscillator to produce low-frequency timing pulses whose frequency is preferably 1 Hz. The 1 Hz output pulses from frequency converter 15 are applied to a stepping motor 17 or other suitable motor for driving a gear train 18 operatively coupled to the hour and minute hands 11 and 12 of the clock.

The output of frequency counter 15 is also fed to a display actuator 19 which counts the timing pulses and produces binary coded decimal signals which are applied to the display drive for the electro-optical station of digital display 13. In practice, display actuator 19 is formed by a plurality of registers, gates, and a decoder which drive the display stations.

Display 13 is constituted by four stations, each of which is preferably formed by a 7-bar segment array of light-emitting diodes that are selectively actuated to produce the digits 0 to 9. To conserve current, in lieu of an LED display, one may use an equivalent LCD display.

Setting of the digital display is accomplished by actuating an hour-set switch 20 and a minute-set switch 21. The hour set switch, when depressed, rapidly advances the hours without disturbing the timekeeping of the minutes. Actuation of the minute-set switch advances the minutes. When the hourset and minute-set switches are released, the display proceeds to advance at its normal time rate under the control of the timing pulses.

In practice, one may first set the digital display in accordance with a standard radio broadcast time signal, then manually adjusts the hands of the clock to conform to the digital display so that they are thereafter in synchronism with each other to provide concurrent analog (12-hour) and digital (24-hour) displays.

But for setting the alarm, the hour- and minute-set switches 20 and 21 are operated to set the display to a desired wake-up time, say, 0800 hours. In order to store this setting, a microprocessor 22 is provided which is associated with a data memory 23. The data input of the microprocessor is provided with a data entry switch 24 such that when the digital display 13 is set to the selected wake-up time, the resultant digital value is entered into memory 23 for storage therein. The digital value for this purpose is derived from display actuator 19.

After the wake-up time is stored, the digital display is reset to indicate the existing time in synchronism with the analog display. Now the digital values from display actuator 19 are received as input data by microprocessor 22, the data being compared with the alarm setting time stored in memory 23.

When the incoming digital data representing existing time is found by the microprocessor to be coincident with the wake-up value stored in memory 23, the microprocessor produces an output signal representative of this condition. This signal acts to trigger an electronic alarm generator 25 which produces a loud signal or buzzer-like tone that is reproduced by transducer 26. Generator 25 is provided with a timed reset circuit which cuts off the generator after a predetermined alarm period, say, one minute. In addition, generator 25, once triggered, may be arranged to repeat the alarm at 10-minute intervals until the generator is manually cut off by operation of switch 25.

Inasmuch as a clock in accordance with the invention includes not only a time computer for actuating a digital display but also a digital computer for comparing the displayed values with stored values to set off an alarm and to carry out other functions, a brief review of computers generally may be helpful in understanding the invention.

A digital computer is a machine capable of carrying out arithmetic or logic operations on digital data entered into its input and of yielding at its output numerical results or decisions. All digital computers, whether in large-scale general-purpose form or in micro-computer form, are essentially composed of a central processing unit, a memory system and an input-output device.

The task assigned to a central processing unit (CPU) is to receive and to store for later processing, data in the form of binary digits or bits (0's or 1's), to perform arithmetic or logic operations on this data in accordance with previously-stored instructions, and to deliver the results to the user of the computer through a read-out device such as a cathode ray display tube.

The number of digits or bits needed to represent a computer instruction or the number of bits needed to represent the largest data element normally processed by the computer is referred to as a "word." The number of bits that a computer is capable of processing as a unit is known as a "byte." A byte may be equal to or less than the number of bits in a word; hence both an 8-bit or a 16-bit word-length computer is capable of processing data in 8-bit bytes.

The central processing unit is that component of the computer which controls the interpretation and execution of instructions. In general, a CPU contains the following elements: "Control" which includes logic and instructions for decoding and executing the program stored in "memory"; "Registers" which provide control with temporary storage in the form of random-access memories (RAM's) and their associated functions; an Arithmetic and Logic Unit (ALU) that performs arithmetic and logic operations under supervision of control; and Input-Output ports (I/O) providing access to peripheral devices such as keyboard switches.

A microprocessor is the central processing unit of a computer with its associated circuitry that is scaled down by integrated-circuit techniques to fit on one or more silicon chips containing thousands of transistors, resistors or other electronic circuit elements. By combining a microprocessor with other integrated circuit chips that provide timing, random access memory, interfaces for input and output signals and other ancillary functions, one can thereby assemble all of the necessary components of a mini-computer whose master component is the microprocessor.

The memory system is that component of a computer which holds data and instructions, each instruction or datum being assigned a unique address that is used by the CPU when fetching or storing the information. There are three distinct types of memories, each of which in a mini-computer can be reduced to a single silicon chip. The read-only memory or ROM is a memory adapted to store information permanently, such as a match function or a micro-program (a special purpose program initiated by a single instruction in the system's main program). A memory that can be programmed by the user, but only once, is known as a programmable ROM or PROM; hence when a PROM is programmed, it then functions as a ROM.

The term read/write memory signifies that the memory is capable of storing information (write) and of retrieving the stored information (read) at an identical or similar rate. In a computer, a random-access memory (RAM) is a read-write memory adapted to store information in such a way that each bit of information can be retrieved within the same amount of time as any other bit.

The capability of a computer depends in good part on storage capacity of its memory system. The amount of information stored ranges from fewer than 100 bits, as in a simple pocket calculator, to more than a billion bits for a large scale computer. Integrated-circuit memories based on transistors are designed to store bits or binary digits on a chip. Currently, the most advanced RAM chip that is available commercially has a maximum storage capacity of 16,384 bits.

The basid "hardware" components of a digital computer are the central processing unit (CPU), the memory system and the input-output (I/O) device. The registers, the control and the arithmetic logic unit of the CPU is linked with the memory system and the I/O device by a data bus; that is, a group of wires that allows the memory, the CPU and the I/O to exchange "words."

The "software" associated with a computer are those expedients by which the computer is explicitly told what to do through a step-by-step sequence of individual instructions which together constitute a program to perform some specific function to yield a solution to a specific problem. An "instruction" is a group of bits that define a particular computer operation. Thus an arrangement may direct a computer to move data, to carry out arithmetic and logic operations, to control I/O devices, or to make a decision as to which instruction is to be executed next.

The present trend is toward 8-bit systems. Suitable for microprocessor 22 is an INTEL 8080 or an INTEL 8085, these being 8-bit machines, as well as a Texas Instruments 1100 microcomputer. Also acceptable are a Motorola 6800, an 8-bit machine similar to INTEL's 808A, and a Fairchild F8, an 8-bit machine in which a complete processor is provided on two chips.

Second Embodiment

Figure 3:
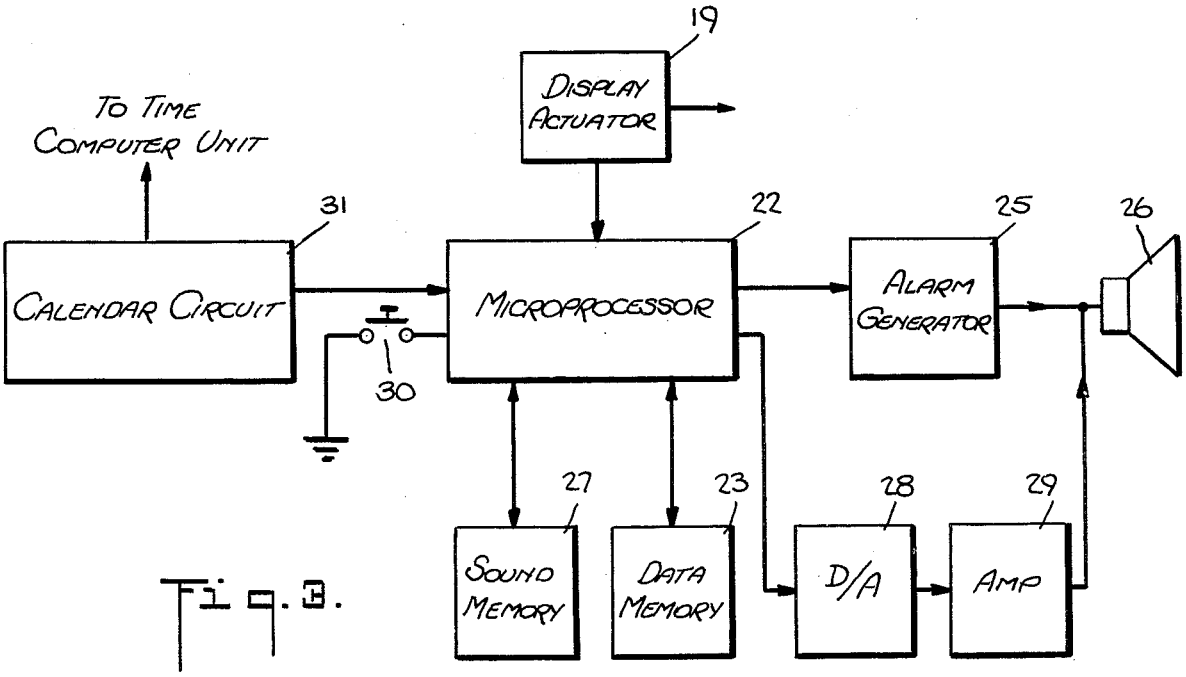
FIG. 3 is a block diagram of another embodiment.

Referring now to FIG. 3, there is shown in simplified block form an arrangement in which the electronic clock not only sounds an alarm at a preset time, but produces musical sounds such as chimes and songs at selected times and dates.

For this purpose, microprocessor 22 has associated therewith a synthesized sound memory 27 capable of storing the desired chimes or songs. Usable for this purpose is a read-only-memory of the type disclosed in the Ichikawa U.S. Pat. No. 3,892,919 and the Barton U.S. Pat. No. 3,870,818 wherein the synthesized sounds are stored digitally, the R-O-M operating in conjunction with a digital-to-analog converter to transform the output of the memory into audible tones.

Thus also associated with microprocessor 22 is a digital-to-analog (D/A) converter 28 whose output is fed to reproducer 26 through a suitable amplifier 29. A switch 30, representing a keyboard or other data input control means associated with microprocessor 22, serves to interrelate the addresses of musical sounds stored in memory 27 with selected times and dates. Alternatively, the algorithm for the microprocessor may be tailored to this purpose.

For example, if the sounds to be produced by the clock are a series of bell-like tones appropriate to given hours in the day, such as Westminster, St. Michael's or Whittington chimes of the type commonly used with grandfather clocks, then these tones in their proper relation to the hours of the day must be stored in sound memory 27, such that when microprocessor 22 receives the digital time data from display actuator 19, and it senses the existing time is coincident with a given hour stored in data memory 23 at which an appropriate chime is to be sounded, then the chime which is in synthesized digital form is extracted from sound memory 27 and decoded in D/A converter 28 to produce an audible signal which is amplified and reproduced by loudspeaker 26.

In lieu of chimes, one may store short tunes, say, of two bar length, each tune being appropriate to a given hour of the day—twenty-four in all. Thus each hour is sounded by a tune unique to that hour, and the owner of the clock, without having to consult the clock face, is thereby advised of the time. For example, at 12 noon, the tune could be "Happy Days Are Here Again," and at twelve midnight, it could be "Good Night Sweetheart," each tune musically expressing the hour.

In addition to hourly tunes or chimes, tunes may be stored which are appropriate to special occasions such as holidays, birthdays, anniversaries, etc. For this purpose, the short tunes are related to given dates, such as December 25 for a merry Xmas tune. It is essential, therefore, that the clock include a calendar circuit 31, such as that disclosed in the Dargent patent, serving to count the days of each month. The calendar circuit is associated with time computer unit 16 so that the four station display 13 can, upon the operation of the appropriate function button, switch over from the time display to a digital data display giving the day and month.

By means of the setting switches for the calendar circuit, one can enter digitally into data memory 23 the special dates at which particular tunes are to be played as well as the hour or hours at which they are to be played on these dates. Thus the clock provides, as with the first embodiment, an analog time display and concurrently functions as a digital calendar timepiece. The two displays are always in synchronism with each other, since both are operated from a common time base.

And because of the calendar operation, one can not only set the clock to provide a daily alarm at a preset time, but by means of the microprocessor associated with the electronic time computer and the related memories, produce musical sounds on an hourly basis or at selected special dates. Thus the calendar clock in accordance with the invention is personalized, for it performs functions uniquely programmed and dedicated to its owner.

It is to be recognized that electronic timepieces having a digital display and including a settable alarm capability are well known, one such timepiece being disclosed in the Coke U.S. Pat. No. 3,946,549 (1976), whose entire disclosure is incorporated herein by reference. A significant aspect of the present invention lies in combining a digital alarm solid-state timepiece of this known type with an electrically operated analog clock whose operation is synchronized with that of the digital timepiece in a manner whereby the digital timepiece functions essentially as a precisely settable alarm for the analog clock and as a means for controlling the generation of chimes and other sounds are predetermined intervals. Thus by means of this invention one can provide an electrically operated analog clock of the floor or grandfather clock type, with the associated digital timepiece micro-computer functioning not only to provide a setting alarm function but also to cause electronic chimes to strike at quarter hour intervals and to produce musical signatures on the hour. The nature of these musical signatures may be such that each hour has its own signature, and the listener is thereby advised of the time, not by counting the number of "bongs" as in a conventional grandfather clock, but by theme recognition. When, for example, he hears the music "Good Night Sweet Heart," he knows it is 11 PM.

Third Embodiment

Figure 4:
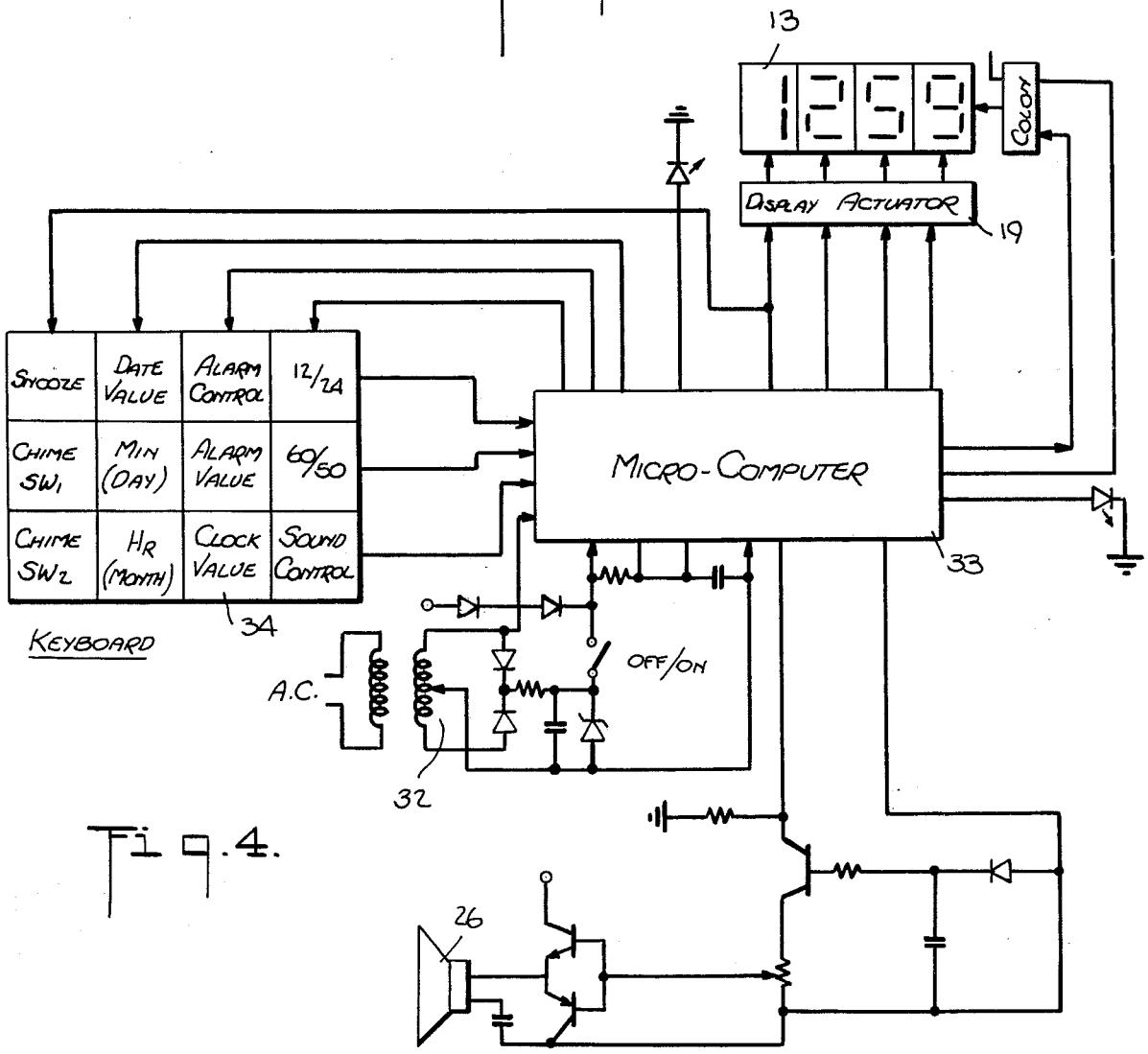
FIG. 4 is a block diagram of an electronic timepiece in accordance with the invention which is also capable of producing chimes, musical time signatures and other special sounds at predetermined times and dates.

In the embodiment illustrated in FIG. 4, only the solid-state digital portion of the timepiece system is shown, the electrically-operated analog clock being omitted. However, this system includes an analog clock which may, for this purpose, incorporate a synchronous motor energized from the standard a-c power line (60 cycles). Since the digital solid-state movement is d-c powered from a rectifier power supply 32 connected to the same a-c line, and the digital solid movement is maintained in synchronism with the constant power-line frequency, the analog and digital timepieces are thereby maintained in exact synchronism.

In this arrangement, use preferably made of a Texas Instruments TMS 1100 microcomputer 33 which includes a ROM, a RAM and an arithmetic logic unit on a single semiconductor chip. This microcomputer is described in the Texas Instruments TMS 1000 Series Data Manual published December 1976 by Texas Instruments Incorporated.

Microcomputer 33 serves to control a digital timepiece with an LED display 13 and includes a synthetic musical capability as disclosed in the previus embodiment, so that it is capable of playing a musical segment or chimes upon the hour through loudspeaker 26. The LED display 13 is used to selectively output the time, date or alarm settings. The values are set via a keyboard 34.

In the keyboard, the key marked Clock Value is the input used to set and display the time. When this key is actuated, digital display 13 will continue to present time until the Alarm Value or Date Value key is manipulated.

The Alarm Value key is used to set and display the alarm value, and once used, the clock will display the alarm value until the Clock Value or Date Value key is used. The Date Value key is the input used to set and display the date value, and once used the clock will display the date value until the Clock Value or Alarm Value key is manipulated. A Birthday Value, which is tied in with the calendar circuits of the micro-computer, is set by simultaneous depression of the Alarm Value and Clock Value keys.

The Hour key is used to set either the hour clock value, the date month value or the alarm hour value, depending on whether the clock is currently in the clock, date or alarm value display mode. When the Hour key is depressed, the high order digits of the display 13 are cycled, making it possible to select the appropriate value upon release of the Hour key. For example, if the timepiece operates in the 24-hour mode, and at the instant the Hour key is depressed the display shows 11, the display will then in sequence show 12, 13, 14, etc. And if the hour is to be set to 19, when this number appears, the key is released. The low order digits will continue to display their current values.

The 12/24 key makes it possible to operate the clock in the 24-hour mode, but if this key is not depressed, the clock will normally function in a 12-hour (AM, PM0 mode. When setting the clock or alarm, the display will cycle when operating in the 24-hour mode between 00:00 and 23:59, and when operating in the 12-hour mode between 12 AM and 11:59 PM. When operating the Date key to set the date, the display will cycle between numbers 1 and 12, representing the month.

The Minute key acts to set either the minute value, the day of the month or the alarm minute value, this depending on whether the clock is in the clock, date or alarm display mode. When the Minute key is depressed, the low order digits of the display are cycled to allow the appropriate value to be selected, the operator releasing the key when the appropriate value appears. The high order digits will continue to display their current value. When setting the clock or the alarm, the low order digits will cycle between 00 and 59. When setting the date, the display will cycle between 1 and 31, representing the day of the month.

The Alarm Control key provides the input that corresponds to a switch which enables the alarm so that the alarm will sound when the set alarm value is reached. In a practical embodiment, the alarm is caused, when activated, to sound "3 bongs"—pause—"3 bongs," this being repeated until the alarm is shut off. It is important to understand that when the Alarm Value Key is actuated, all other modes of operation are rendered inactive and the timepiece only functions to give an alarm at the time set therefor.

The Sound Control key corresponds to a switch which enables either music or chimes to be played by the clock. If enabled for music, the clock will play a musical segment of a different song for each hour in the day (1 to 12). For example, at hour 1, "Raindrops"; at hour 2, "Moon River"; at hour 3, "Beautiful Dreamer"; at hour 4, "Barcarolle," and so on.

When enabled for chimes instead of music, the chimes will be played in their entirety on the hour, this being followed by the number of "bongs" appropriate to that hour. On the first, second and third quarter hour, the first four, eight and twelve notes of the chime, respectively, are sounded, the full set of chime notes being heard only on the hour.

When the alarm is sounded, the Snooze key provides an input that can be used to reschedule the alarm to sound 10 minutes later, this procedure being repeated. The Snooze key does not, however, affect the alarm value.

The Chime Switch keys $SW_1$ and $SW_2$ are used to select chimes, but if neither Switch is operative, then music will be played. Otherwise, a typical switch selection for chimes is such that operation of key $SW_1$ results in Westminster chimes, operation of key $SW_2$ in Whittington chimes, and operation of both switches, in St. Michael's chimes.

While there have been shown and described preferred embodiments of an electronic alarm clock in accordance with the invention, it will be appreciated that many changes and modifications may be made therein without however departing from the essential spirit thereof. For example instead of musical time signatures, one can store a verbal message such as "time for conference" so that at preset times, the user of the clock is reminded of scheduled meetings or other events.

I claim:

1. An electronic timepiece having an analog display produced by timekeeping hands representing hours and minutes and a concurrent digital display operating in conjunction with a digital setting system for activating an alarm at a preset time, said timepiece comprising:

A. a common high-frequency crystal-controlled time base;

B. a frequency converter in the form of a binary frequency divider coupled to said time base to produce low-frequency timing pulses;

C. a motor responsive to the timing pulses to drive said timekeeping hands on a scale of 12;

D. an electro-optical display having at least four stations to provide readings of hours and minutes on a scale of 24;

E. a settable electronic actuator responsive to the timing pulses to produce digital values for concurrently actuating the digital display to provide digital time indications in synchronism with the analog display provided by the hands;

F. hour and minute setting switches operable to set the digital display to a selected wake-up alarm time;

G. a microprocessor coupled to said digital display actuator and having associated therewith a data memory operatively coupled to said switches for storing the digital value of a selected alarm setting, said microprocessor comparing the changing digital values from said digital display actuator corresponding to existing time with the stored value to produce a representative output signal when these values are coincident;

H. means responsive to said output signal to generate an alarm; and

I. a synthesized sound memory for storing in digitized form different musical sounds related to the respective hours of the day which are stored in said data memory, said microprocessor when the digital values representing existing times are coincident with said stored hours extracting said digitized sounds from said sound memory and applying said digitized sounds to digital-to-analog converter to produce musical sounds which are reproduced.

2. A timepiece as set forth in claim 1, wherein said electro-optical display is formed by at least four light-emitting diode stations.

3. A timepiece as set forth in claim 1, wherein said alarm generating means includes an alarm signal generator which is triggered by said output signal and is reset after a predetermined interval.

4. A timepiece as set forth in claim 1, further including a settable calendar circuit responsive to said timing pulses to count the days of the month and coupled to said actuator to cause said electro-optical display to provide a digital date reading.

5. A timepiece as set forth in claim 4, wherein special dates are digitally stored in said data memory and synthesized musical sounds appropriate to said special dates are stored in the sound memory and are extracted therefrom by said microprocessor on said special dates and are reproduced.

6. A timepiece, as set forth in claim 1, wherein said stored sounds for representing the hours are chimes.

7. A timepiece as set forth in claim 1, wherein said stored sounds for representing the hours are tunes which are different for each hour.

* * * * *